US007273297B2

(12) United States Patent
Cranor et al.

(10) Patent No.: US 7,273,297 B2
(45) Date of Patent: Sep. 25, 2007

(54) NOVELTY PRODUCT WITH CHEMILUMINESCENT AND LED LIGHTING SYSTEM

(75) Inventors: Earl Cranor, Longmeadow, MA (US); Frank Carter, West Springfield, MA (US)

(73) Assignee: Cyalume Technologies, Inc., West Springfield, MA (US)

( * ) Notice: Subject to any disclaimer, the term of this patent is extended or adjusted under 35 U.S.C. 154(b) by 184 days.

(21) Appl. No.: 10/998,303

(22) Filed: Nov. 26, 2004

(65) Prior Publication Data

US 2006/0114671 A1 Jun. 1, 2006

(51) Int. Cl.
*F21S 19/00* (2006.01)

(52) U.S. Cl. ..... 362/228; 362/84; 362/34; 362/802

(58) Field of Classification Search ..... 362/34, 362/84, 228, 802; 200/61.01, 61.1; 446/175
See application file for complete search history.

(56) References Cited

U.S. PATENT DOCUMENTS 4,346,640 A * 8/1982 Zeno et al. ..... 84/464 R
4,635,166 A * 1/1987 Cameron ..... 362/34
4,791,536 A * 12/1988 James ..... 362/104
5,056,399 A * 10/1991 Hornstein ..... 84/464 R
5,276,599 A * 1/1994 Neeley ..... 362/301
5,400,232 A * 3/1995 Wong ..... 362/276
5,550,721 A * 8/1996 Rapisarda ..... 362/205
5,984,754 A * 11/1999 Freelander ..... 446/73
6,513,945 B1 * 2/2003 Wyss et al. ..... 362/34
6,527,408 B1 * 3/2003 Korenek, Jr. ..... 362/184
6,758,572 B2 * 7/2004 Ladyjensky ..... 362/34
2002/0176244 A1 * 11/2002 Park et al. ..... 362/34
2004/0264176 A1 * 12/2004 Vanderschuit ..... 362/106
2005/0094395 A1 * 5/2005 Rosenberg ..... 362/249
2005/0213343 A1 * 9/2005 Jablonski ..... 362/602
2005/0219837 A1 * 10/2005 Brown ..... 362/105

* cited by examiner

*Primary Examiner*—Jong-Suk (James) Lee
*Assistant Examiner*—Ismael Negron
(74) *Attorney, Agent, or Firm*—McHale & Slavin, P.A.

(57) ABSTRACT

A device combining a chemiluminescent and an LED lighting element. By way of illustration, depicted is a stylized "cartoon" ghost representation having a first portion and a second portion, the first portion including a cavity for receipt of the chemiluminescent element in packet form, and the second portion including the LED lighting elements and an electrical circuit and battery coupled thereto. The chemiluminescent element can be manually activated and inserted into the compartment of the first portion. The LED lighting elements may be manually activated or activated by sensor elements.

7 Claims, 6 Drawing Sheets

NOVELTY PRODUCT WITH CHEMILUMINESCENT AND LED LIGHTING SYSTEM

FIELD OF THE INVENTION

This invention is related to the field of novelty goods and in particular to a novelty product that combines chemiluminescent and LED lighting elements.

BACKGROUND OF THE INVENTION

Disclosed is a novelty product that combines chemiluminescent and LED lighting elements. While the novelty product can be of most any shape and size, for ease of discussion a single non-limiting but fully illustrative embodiment will be disclosed and directed to a novelty product that has the appearance of a "ghost."

In the disclosed embodiment of a ghost, the chemiluminescent lighting element described herein is used to provide a glow to create a supernatural type of effect. By way of background, the idea of ghosts as disembodied human spirits is iconic in popular western culture. In movies and other entertainment media, "ghosts" are depicted in numerous ways. For example, they can be shown as eerily translucent human figures, or a glowing amorphous mass. Children's entertainment often includes non-threatening "ghost" characters, the most famous of which is Casper the Friendly Ghost®.

"Ghost" characters have visual appeal to children because they have bulbous bodies reminiscent of soft toys and large friendly features. This is true for similar such products such as a snowman, dough boy, and the like.

Various forms of chemiluminescent elements are well known in the art, and a preferred albeit non-limiting type of chemiluminescent device is described in detail in Assignee's related U.S. Pat. No. 6,758,572, the contents of which are incorporated herein by reference. Generally speaking a chemiluminescent device involves two compartments or chambers, each containing a chemiluminescent reaction component, e.g. one containing an oxalate solution, and the other containing an activator solution. The chambers keep the reactants separated until the time of activation, whereupon the two chemicals are permitted to mix and the reaction creates the chemiluminescent light.

Thus, the invention as described herein provides a novel housing in the form of a toy "ghost" or the like, for the combination of disposable chemiluminescent elements and an integral LED lighting system in order to create a highly entertaining and unique novelty product.

SUMMARY OF THE INVENTION

The present invention is a novelty product that combines a manually activatable chemiluminescent element with a manual or sensor activated LED lighting display. In the disclosed embodiment, the novelty product is based on a structure formed from transparent, translucent, and/or semi opaque material having a cavity for receipt of chemiluminescent elements. An exemplary chemiluminescent elements well suited for this application is packaged in a packet form which has at least two chambers filled respectively with an oxalate solution and an activator solution. In practice, one of the solutions, e.g. the oxalate solution is in a tightly-closed pouch of thin aluminum foil, lined on its interior side by a polymer, and providing a first chamber.

This pouch is itself enclosed in a larger tightly-closed pouch, made of translucent polymeric film, providing a second chamber, which also contains the liquid activator chemical. The inner pouch is manually burstable to allow admixing of an activator and oxalate for chemiluminescent light. Alternatively, light sticks may be used by placement in such a manner as to cause illumination of the novelty product.

The device generally includes a body formed from a plastic material which has the appearance of a "ghost" character. The body can be injection molded plastic or the like, and is formed to provide a generally hollow cavity which may include an upper head portion and a lower body portion. The upper head portion includes a depiction of stylized facial features thereon. The upper head portion further includes a compartment therein configured to receive the chemiluminescent element.

One or a plurality of LEDs may be mounted in mechanical engagement with the hollow cavity, and an electrical circuit means is electrically coupled to the LEDs and mounted within or upon said cavity as well. A battery housing is also disposed within or upon the cavity and coupled to the circuit means, whereby the chemiluminescent element can be manually activatable and inserted into the compartment and the novelty toy is illuminated by both the chemiluminescent element and the LEDs.

Thus, an objective of the invention is to provide a unique novelty toy in the form of a cartoon "ghost" figure which utilizes a chemiluminescent light in combination with battery powered LEDs.

It is another objective of the invention to provide a unique novelty toy which provides a unique housing for easy to manufacture chemiluminescent lighting elements.

It is still another objective of the invention to provide a unique novelty toy which utilizes inexpensive, disposable chemiluminescent packets which are manually activatable.

It is still a further objective of the invention to provide a unique novelty toy which requires user participation to activate the chemiluminescent element thus enhancing the entertainment value of the device.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE FIGURES

The invention will be better understood with reference to the annexed drawings, shown as examples. In these drawings.

DETAILED DESCRIPTION OF THE INVENTION

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

Figure 1:
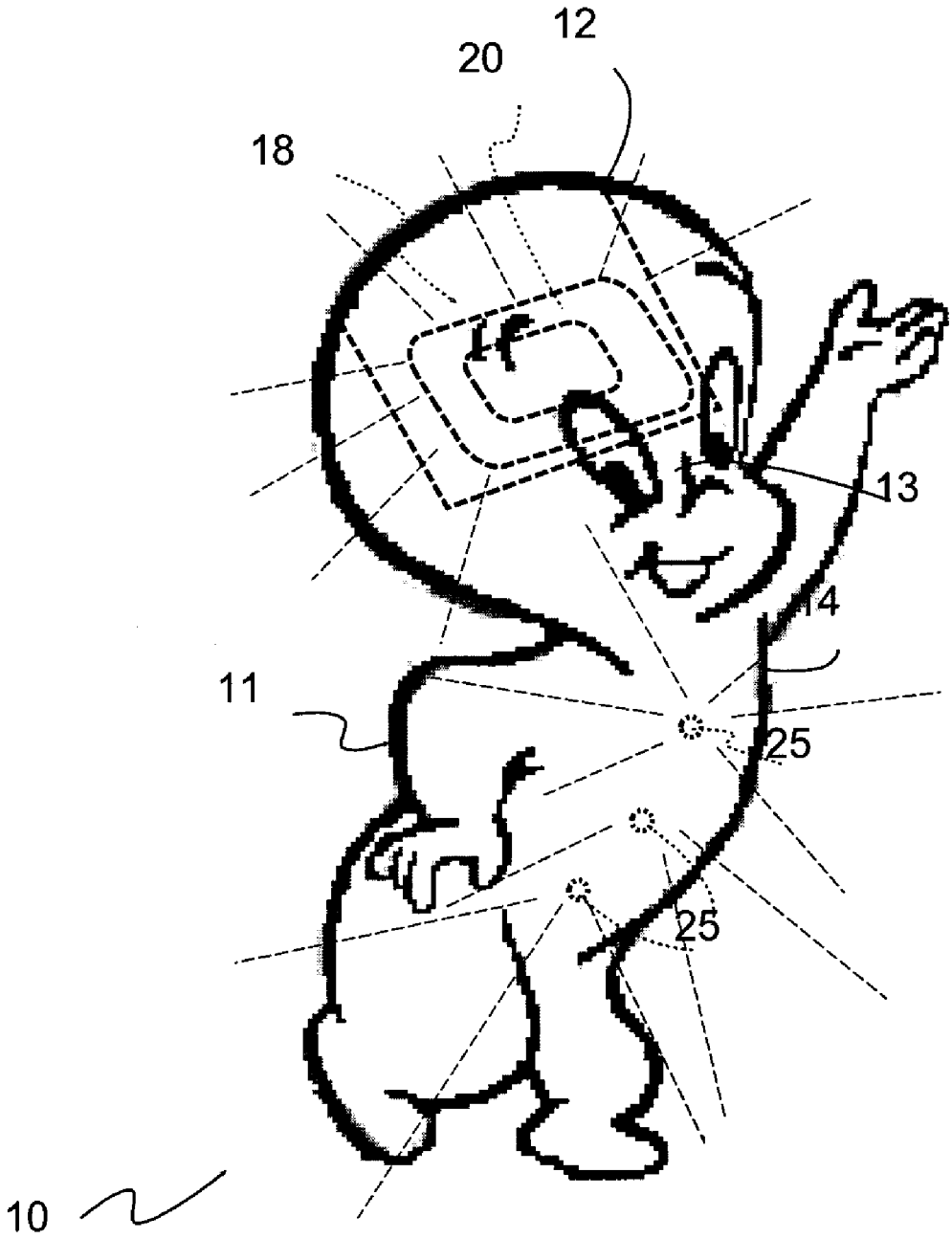
FIG. 1 is a pictorial view of the novelty toy according to a preferred embodiment of the invention

FIG. 1 pictorially illustrates a novelty toy 10 according to a disclosed embodiment of the invention. The novelty toy 10 includes a housing in the form of body 10 which is manufactured to have the appearance of a stylized cartoon "ghost" figure such as Casper the Friendly Ghost®. The body 11 is preferably of a transparent, translucent, and/or semi-opaque light colored plastic, and can be formed using any injection or plastic molding technique. The body 11 is formed to provide a generally hollow interior space, and can optionally include interior partitions to define preformed compartments within the body 10 as shown in the cross-sectional view shown in FIG. 2. Additional sources of luminescence, such as photoluminescence and reflectivity, may be placed upon the surface of the novelty item to achieve additional light effects. This is accomplished by application of a reflective material such as the present assignee's GLO-FLEX® reflective and photoluminescence at any desired position on the surface thereof. This material is not shown on the drawings for purposes of clarity. The body 11 is depicted as having an upper head portion 12 and a lower body portion 14. The upper head portion 12 has stylized depictions of facial features 13 thereon in a darker contrasting color such as the eyes and mouth shown in FIG. 1. The configuration of the body 10 defines a front side 21 and a rear side 22, with the facial features being positioned on the front side 21. The lower body portion 14 can have any desired configuration to suggest a "ghost" like shape. The body can be somewhat amorphous in shape, or it can be formed as an approximate representation of a human figure with limbs, hands, feet and a torso.

The upper head portion 12 includes an accessible inner compartment 18 which is configured to receive a chemiluminescent lighting element 20. The compartment 18 can be accessed through an opening in the rear side 22, and can be integrally formed with the body 10. The positioning of the compartment 18 allows the chemiluminescent element 20 to be readily inserted and removed as desired.

Figure 2:
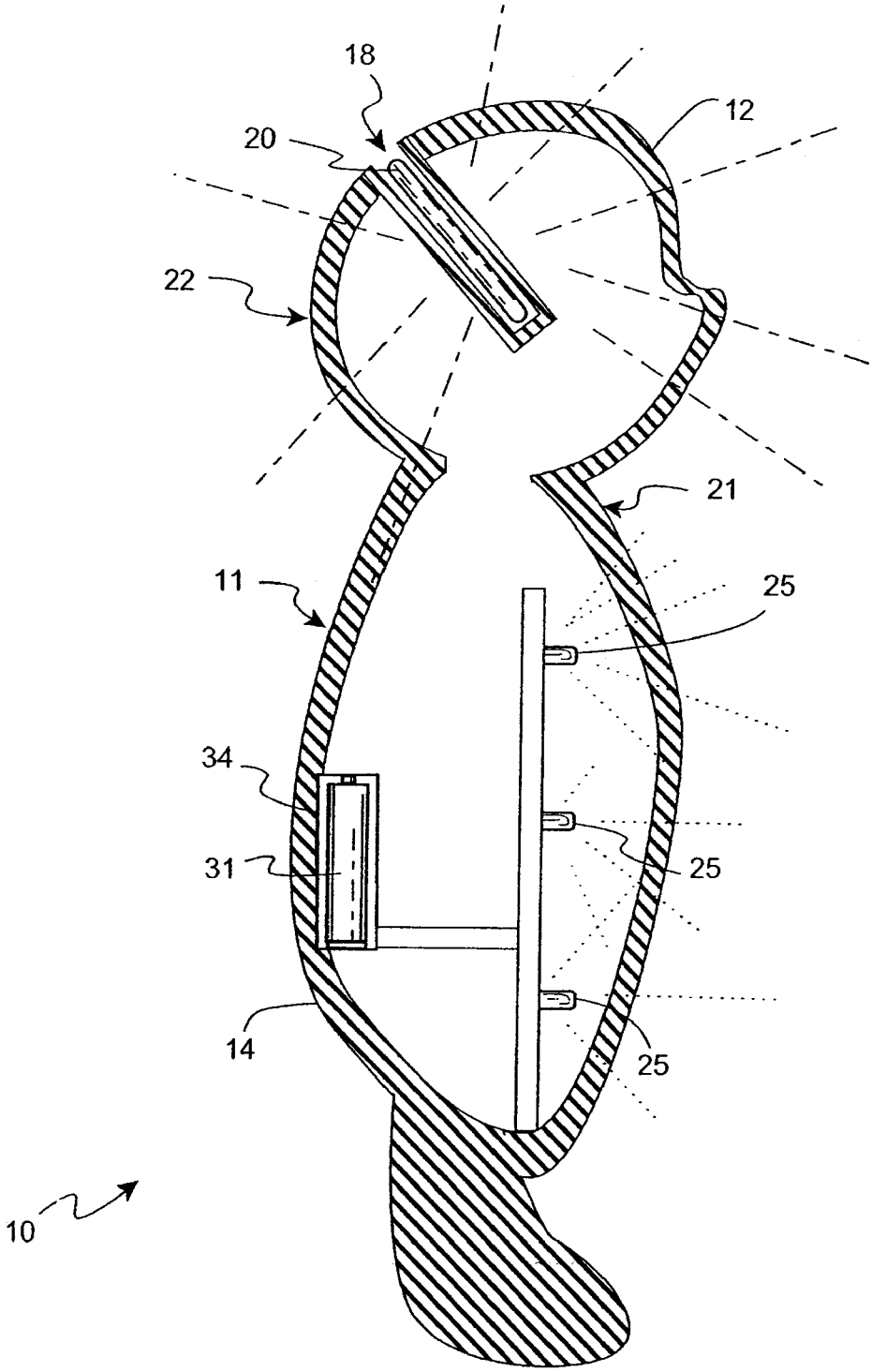
FIG. 2 is a cross-sectional view of the novelty toy shown in FIG. 1.
Figure 3:
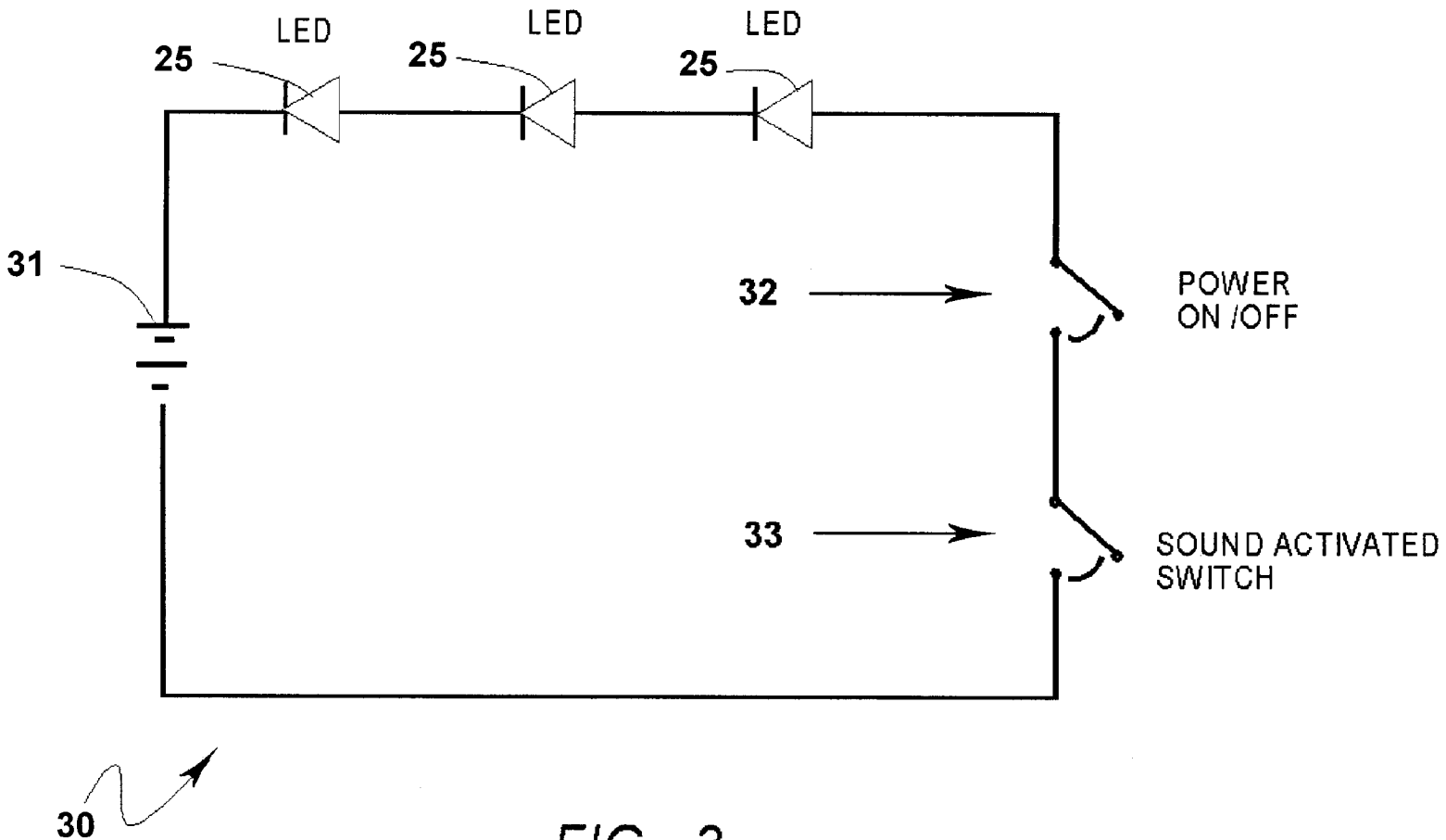
FIG. 3 is a schematic diagram of the LED circuit.

At least one light emitting diode (LED) 25 is mounted within or upon the housing. In the preferred embodiment, a plurality of LEDs 25 are utilized. An electrical circuit means 30 is also mounted within or upon the housing, in this case the lower body portion 14, and coupled to the plurality of LEDs, as shown in FIG. 3. The electrical circuit means is coupled to a battery 31 and at least one switch means 33. As shown in FIG. 2, a battery housing 34 may be located in the lower body portion 14 or in any other location which can receive the battery 31. In the illustrated embodiment, the battery housing 34 is preferably positioned to allow access from the rear side 22 of the body 11, however the placement of the battery housing 34 can depend on the configuration of the body 11.

The switch means 33 selectively makes and breaks the electrical contact between the LEDs 25 and battery 31. The switch means 32 can comprise a manually operated toggle switch which allows a user to selectively illuminate the LEDs 25. The switch means 33 can also be a sound or motion activated switch which illuminates the LEDs 25 in response to audible sound or movement respectively.

The source of chemiluminescence, in a preferred albeit non-limiting example, is represented as a chemiluminescent element 20, and is shown as a manually activatable packet which has at least two chambers filled respectively with an oxalate solution and an activator solution. FIG. 4-7 illustrate preferred embodiments of the chemiluminescent elements to be used in accordance with the invention. The inner pouch 1 is made of two aluminum foils 2 and 3, sealed together along their periphery 4, and are illustrated as being rectangular in FIGS. 4 and 5, and circular in FIGS. 6 and 7. The inner pouch 1 can also be formed from a single sheet of aluminum foil which is folded in half and sealed along the periphery.

The inner pouch 1 contains one of the reactants, e.g. an oxalate liquid chemical solution. The outer pouch 6 can be made of two films 7 and 8, of translucent soft polymer, preferably polyolefin, for instance polyethylene or polypropylene, sealed along a periphery 9, rectangular in FIGS. 4 and 5, and circular in FIGS. 6 and 7. The outer pouch 6 contains the other reactant, e.g. an activator liquid. The outer pouch can also be formed from a single sheet of film which is folded in half and sealed along the periphery.

The chemiluminescent element 20 involves, optionally, a steel ball 111 or a hard particle on which the user will push in order to pierce the aluminum pouch, and thereby induce the activation process. Alternatively, this ball or particle need not be used, and the pouch may simply be burst by pressure. In that case, it is suitable to incorporate an area of weakened resistance, for instance a welding line. Each of the two aluminum foils may be lined, by coating, laminating, or other technique, with a coat of polymeric lacquer, on their surfaces which are to be in face-to-face relation. This lacquer coat, preferably based on a polypropylene, modified or not, is provided to ensure the adhesion of the two foils together by thermal sealing along their periphery. This coat is not represented on the drawings for reasons of clarity.

This polymeric coat, in addition to adhesion, also insures a good compatibility between the aluminum material and the reactant solution which is delicate and sensitive to contaminations, and is compatible with relatively few materials. This coat is very thin, in order not to increase the mechanical resistance of the aluminum, which must rupture easily.

In addition to this coat, it is possible to also incorporate a thin soft film of polypropylene 113 between the two aluminum foils. This film will be retained therein by the act of sealing and will contribute to the quality of the sealing. Of course the oxalate solution will be between this soft film and one of the aluminum foils, the one to be pierced.

The chemiluminescent element 20 may further optionally include a felt 112 (succession of small crosses on the drawings) made of nonwoven material of which the fibers are preferably from the same polymer as the films of the outer pouch. It will be retained between the two films by the peripheral thermal sealing. During the storage of the lighting element before use, this felt will have time to absorb the activator liquid in its entirety and spread it uniformly in the pouch. The result will be a good uniformity in light emission after the liberation of the oxalate solution, because the two chemical liquids avidly diffuse into each other within a short time. The level of activator liquid is provided at the time of filling and is later absorbed in the felt as indicated above.

Once substantially emptied, the aluminum pouch remains in place and acts as a reflector; wherein substantially the whole of the luminous emission emanates from the same side of the aluminum pouch, –the pierced side. There is almost no liquid at the other side. This intense unidirectional emission of light represents a distinct advantage over the prior art.

Frequently the inner pouch may not be entirely emptied by the user at the time of initial activation. A portion of the chemiluminescent reactants remain inside because of some creases or other flow impediments. It is then advantageous, as the light weakens over time, due to the unavoidable chemical energy consumption of the system, to manipulate the element with some kneading action, in order to extract the remains of oxalate solution contents out of the inner pouch. One can then see a kind of regeneration of the luminous emission, which may be controlled by the user.

Figure 4:
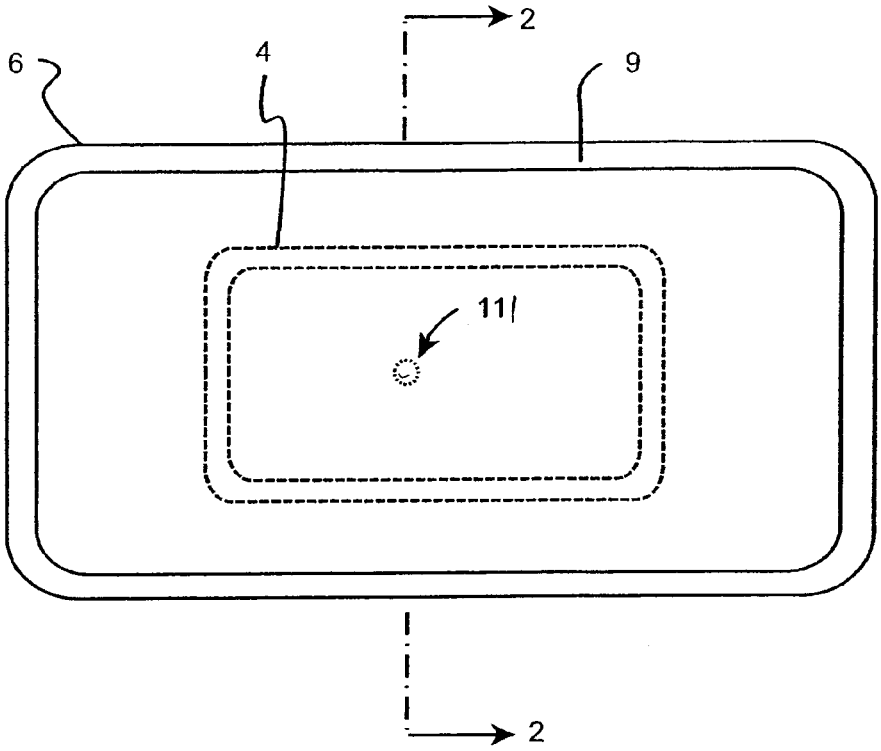
FIG. 4 represents a top plan view of the chemiluminescent element according to the invention.
Figure 5:
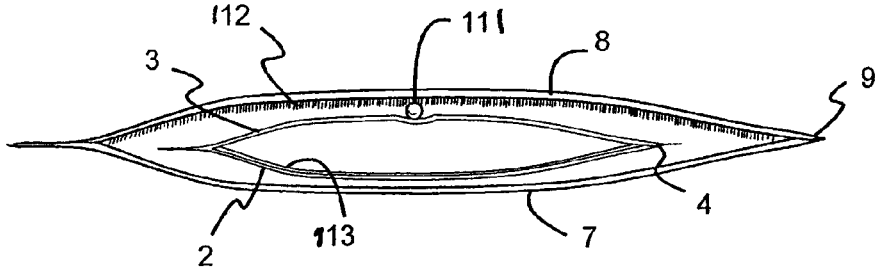
FIG. 5 is a cross-sectional view of same chemiluminescent element shown in FIG. 4.
Figure 6:
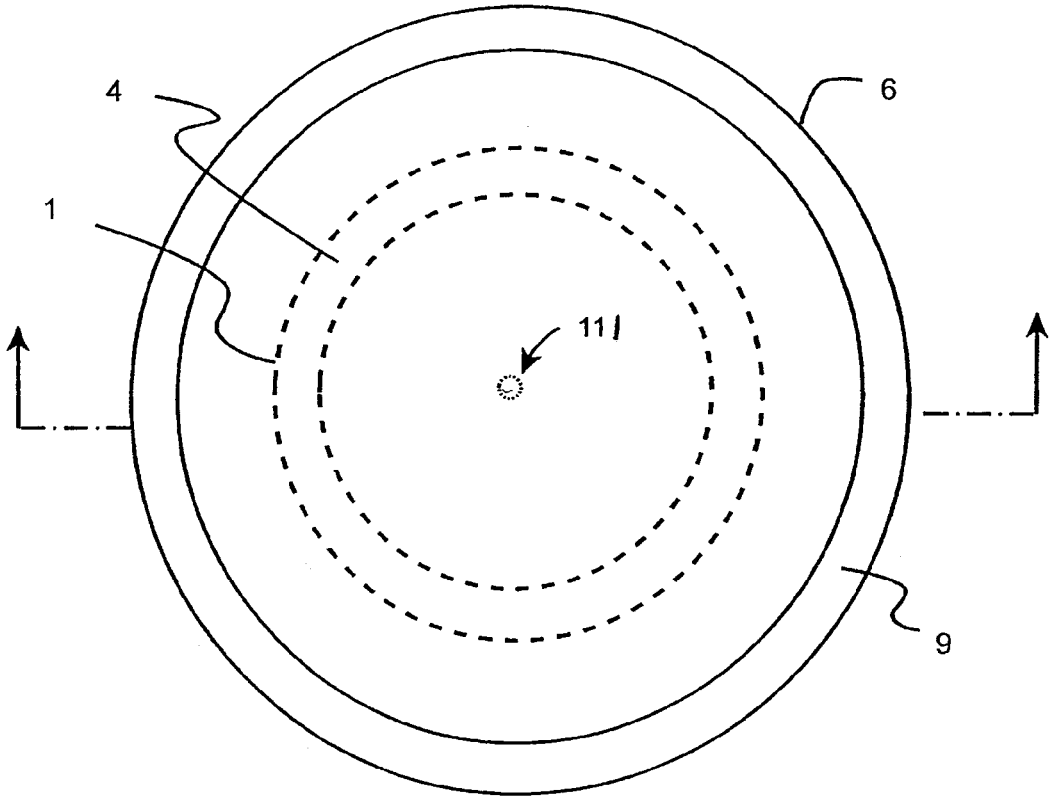
FIG. 6 is a top plan view of another embodiment of the chemiluminescent element.
Figure 7:
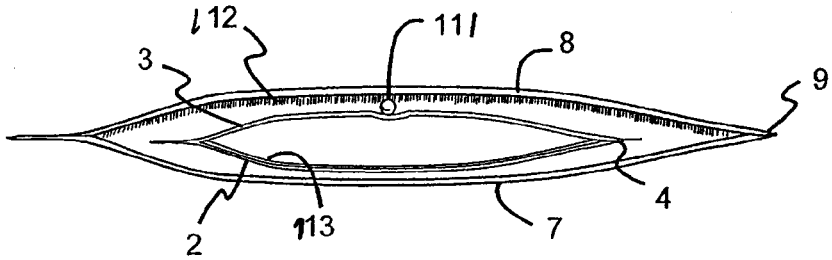
FIG. 7 is a cross-sectional view of the chemiluminescent element shown in FIG. 6.

In FIGS. 4 and 5 the element is shown as having a rectangular form, and in FIGS. 6 and 7, a circular form, but of course the peripheral sealing can have any other form, and, particularly, for advertising or promotional purposes, be made under the form of a brand logo.

Figure 8:
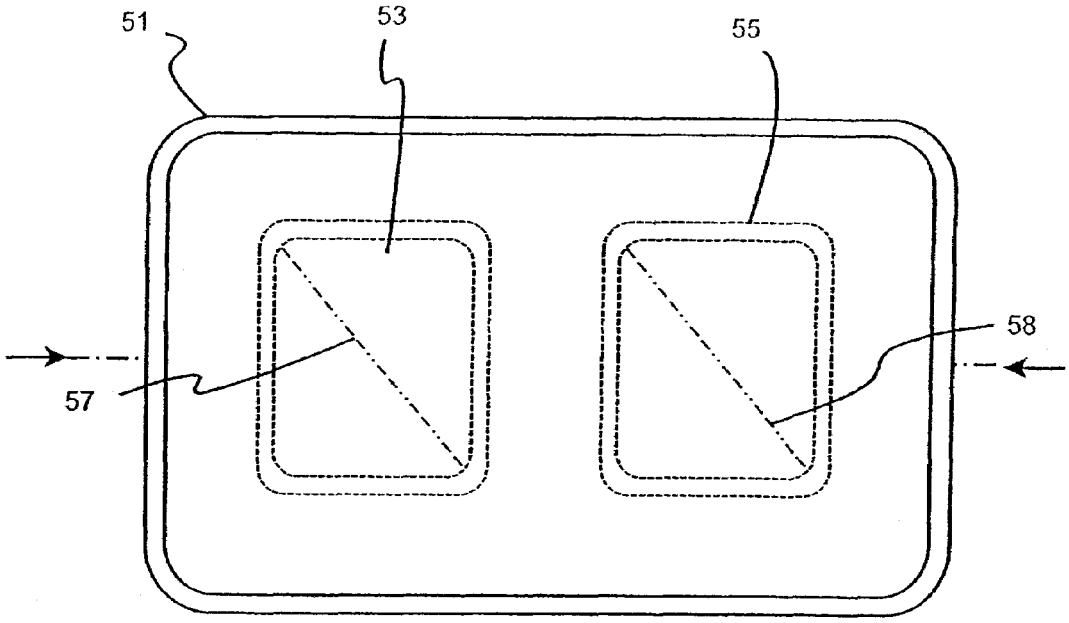
FIGS. 8 is a top plan view of an alternative embodiment of the chemiluminescent element including two inner pouches.
Figure 9:
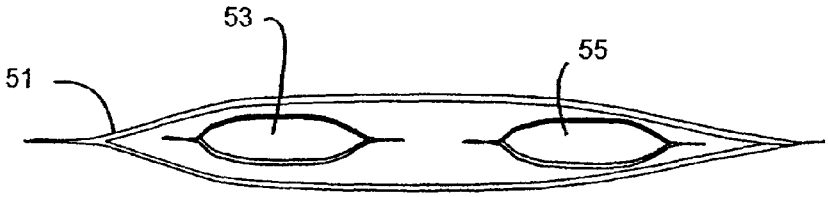
FIG. 9 is a cross section view of the chemiluminescent element of FIG. 8 taken along the line 6-6.

FIGS. 8 and 9 illustrate another embodiment of the present invention in which two inner pouches 53 and 55 are disposed in an outer pouch 51. While two inner pouches are illustrated, the invention is not limited in this regard as any number of inner pouches may be included. The inner pouches 53 and 55 and outer pouch 51 can be constructed in the same manner as described for the embodiments shown in FIGS. 4-7. The inner pouches 53 and 55 can contain two identical activators, or activators having different colored dyes. It may also be advantageous to separate the dye from the oxalate solution into separate inner pouches due to the fact that the dyes can cause the oxalate solution to breakdown.

In the illustrated embodiment, the inner pouches 53 and 55 respectively include frangible seams 57 and 58. The frangible seams 57 and 58 allow the inner pouches 53 and 55 to be ruptured by manual manipulation. As discussed above, a steel ball or other hard object can be used to burst the inner pouches 53 and 55.

In use, the chemiluminescent element 20 is manually manipulated so that the inner pouch is burst thus providing a luminous emission. The chemiluminescent element is then inserted into the compartment 18. The semi-opaque plastic of the body 11 is selected to be sufficiently translucent that the light from the chemiluminescent element 20 penetrates and shines through the body 11 to create a glowing effect. The LEDs can also be activated to provide further illumination. In this way, the novelty toy 10 of the invention is simultaneously illuminated by both the chemiluminescent element and the LEDs to provide an amusing "glowing ghost" effect.

It is noted that the novelty product is not limited to a ghost figure. For instance, a snowman or dough boy provides a substitute structure without change to the function. Further, items such as a baseball, football, soccer ball, or the like may all be used. A soccer ball may use the chemiluminescent lighting to provide a constant glow and when the ball is kicked, the LED's may be activated by a motion sensor to provide an enhanced lighting effect.

Another example is a baton wherein the chemiluminescent lighting element allows the baton to glow and the LED can be activated by sound. In this embodiment, the baton can be used in a marching band and will glow at all times. When the sound of a large noise, such as that provided by drums, results in the activation of the LED. Thus, the baton may be tossed high into the air and the LED's activated by another source.

Yet an additionally contemplated embodiment to further enhance light reflection is to place additional sources of photoluminescence on the surface of the novelty item. This is accomplished by application of a reflective material such as the present assignee's photoluminescent material GLO-FLEX®.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification. One skilled in the art will readily appreciate that the present invention is well adapted to carry out the objectives and obtain the ends and advantages mentioned, as well as those inherent therein. The various methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A device comprising:

a manually activatable chemiluminescent element;

a body defining a generally hollow cavity;

said cavity configured to receive said chemiluminescent element;

at least one LED in mechanical engagement with said cavity;

an electrical circuit means electrically coupled to said at least one LED and placed within or upon said cavity; and a battery housing positioned within or upon said cavity and coupled to said circuit means;

at least one photoluminescent and reflective article in mechanical engagement with said body;

whereby said chemiluminescent element is manually activated and inserted into said cavity and said device is simultaneously illuminated by both said chemiluminescent element and said at least one LED.

2. The device of claim 1, wherein said chemiluminescent lighting element comprises at least first and second chambers each containing therein one part of a two-part chemiluminescent reaction composition, said first chamber defined by a first tightly-closed pouch formed of a thin aluminum foil, lined on its interior side by a polymer, and being enclosed within a second tightly-closed pouch formed of translucent polymeric film and defining the second chamber.

3. The device of claim 1, wherein said body is formed from injection molded plastic.

4. The device of claim 3, wherein said cavity is integrally formed with said body.

5. The device of claim 1, further including switching means for selectively making and breaking electrical contact between said at least one LED and a battery.

6. The device of claim 5, wherein said switch means is sound activated.

7. The device of claim 5, wherein said switch means is motion activated.

* * * * *